US009859651B2

(12) United States Patent
Suzuki et al.

(10) Patent No.: US 9,859,651 B2
(45) Date of Patent: Jan. 2, 2018

(54) LEVER TYPE CONNECTOR

(71) Applicant: Yazaki Corporation, Tokyo (JP)

(72) Inventors: Etsurou Suzuki, Makinohara (JP); Yasuharu Kondo, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/286,103

(22) Filed: May 23, 2014

(65) Prior Publication Data

US 2014/0256169 A1 Sep. 11, 2014

Related U.S. Application Data

(63) Continuation of application No. PCT/JP2012/007429, filed on Nov. 20, 2012.

(30) Foreign Application Priority Data

Nov. 24, 2011 (JP) ..... 2011-255829

(51) Int. Cl.
*H01R 13/629* (2006.01)

(52) U.S. Cl.
CPC . *H01R 13/62955* (2013.01); *H01R 13/62938* (2013.01)

(58) Field of Classification Search
CPC ..... H01R 13/62955; H01R 13/62938
USPC ..... 439/152–160
See application file for complete search history.

(56) References Cited

U.S. PATENT DOCUMENTS 5,344,194 A * 9/1994 Hatagishi et al. ..... 285/26
5,609,494 A * 3/1997 Yamaguchi ..... H01R 13/62933 439/157
5,823,809 A * 10/1998 Wakata ..... H01R 13/5202 439/157
7,258,557 B2 * 8/2007 Matsubara et al. ..... 439/157
2005/0221648 A1 10/2005 Deno et al.
2006/0211286 A1 9/2006 Shuey
2008/0102666 A1 5/2008 Yamashita
2009/0023317 A1 1/2009 Mizoguchi et al.
2011/0230080 A1 9/2011 Shamoto et al.

FOREIGN PATENT DOCUMENTS

GB 2442845 A 4/2008
JP 2001-257032 A 9/2001
JP 2011-146249 A 7/2011

OTHER PUBLICATIONS

International Search Report and Written Opinion dated Jan. 24, 2013, issued for PCT/JP2012/007429.

* cited by examiner

*Primary Examiner* — Edwin A. Leon
*Assistant Examiner* — Paul Baillargeon
(74) *Attorney, Agent, or Firm* — Locke Lord LLP

(57) ABSTRACT

A lever type connector preventing a lever from disengaging from a connector housing due to application of force and providing rigidity to withstand rotational operation of the lever without increasing size is provided. Provided are a lever including a lever having a pair of side plate portions rotatably supported on walls on both sides of a connector housing and an operation portion connecting the pair of side plate portions, a latch portion arranged on the operation portion, an arm portion extending from a rear end side of an upper wall of the connector housing and having a rearward-extending free end, and a latch receiving portion provided on the free end to latch onto the latch portion.

4 Claims, 14 Drawing Sheets

LEVER TYPE CONNECTOR

TECHNICAL FIELD

The present invention relates to a lever type connector in which a connector housing is moved toward a mating connector and fitted to the mating connector by a rotational operation of a lever.

BACKGROUND ART

FIG. 21 is an exploded perspective view of a connector having a conventional lock structure. This connector includes a male connector 101 and a female connector 102 arranged to fit to the male connector 101. The lock structure of this connector includes an engagement projection 107 arranged on an outer surface of one connector housing 103 of the male and female connectors 101, 102 having multipolarized terminals 106, a lock aim 115 having an engagement claw 116 arranged to latch onto the engagement projection 107 and arranged on an outer surface of the other housing 104 via an elastically deformable hinge-like leg 117, and a press operation lever 118 arranged on a rear end of the lock arm 115 extending rearward than the hinge-like leg 117. This press operation lever 118 includes a pair of end pieces 119 extending outward from both sides of the press operation lever 118 and curved downward so as to continue to an outer surface of an upper wall of the connector housing 104. With the pair of end pieces 119, the connector having the lock structure can provide the improved rigidity to the press operation lever 118 without an increase in size (refer to Patent Literature 1). However, in the connector disclosed in Patent Literature 1, a connector fitting operation force tends to increase with increasing number of the multipolarized terminals 106 of the male and female connectors 101, 102.

Therefore, there is employed a lever type connector arranged to reduce the fitting operation force using a lever (refer to Patent Literature 2). FIG. 22A is a partial cross-sectional view of a conventional lever type connector, and FIG. 22B is an enlarged view of a portion shown in FIG. 22A. As shown in FIGS. 22A and 22B, this lever type connector 201 shown in Patent Literature 2 includes a connector housing 202, a wire cover 240 attached to the connector housing 202 to lead out an electric wire, and a lever 230 rotatably attached to the connector housing 202 and arranged to rotate to make a mating connector moved toward the connector housing 202 and fitted to the connector housing 202. The wire cover 240 includes a lock portion 245 formed at a tip end of a lock arm 242. The lever 230 includes a lever claw portion 236 arranged to latch onto the lock portion 245 and a lock protection portion 237 formed on an engagement side of the lever claw port on 236 so as to cover the lock portion 245. By covering the lock portion 245 with the lock protection portion 237 of the lever claw portion 236, the lever type connector 201 prevents the lock portion 245 from being damaged or deformed.

CITATION LIST

Patent Literature

[Patent Literature 1]
Japanese Patent Application Publication No. 2001-257032

[Patent Literature 2]
Japanese Patent Application Publication No. 2011-146249

SUMMARY OF INVENTION

Technical Problem

The above-described conventional lever type connector 201 needs to be reduced in height (i.e. downsized) due to a small space in a height direction for mounting the lever type connector 201. Thus, there was an attempt to reduce a thickness of an operation portion 234 of the lever 230 to reduce the height of the lever type connector 201. However, if the thickness of the operation portion 234 is reduced, then it is difficult to ensure enough rigidity of the operation portion 234 to withstand the rotational operation of the lever 230.

On the other hand, when the thickness of the operation portion 234 is increased to ensure its rigidity, the size of the lever type connector 201 is increased. Thus, in the lever type connector 201, it is difficult to ensure the rigidity of the operation portion 234 at the same time reducing the height of the operation portion 234. Furthermore, the lock structure of the connector shown in Patent Literature 1 cannot be applied to this lever type connector 201.

Moreover, in the conventional lever type connector 201, the lock protection portion 237 is arranged to cover only the lock portion 245 located at the tip end of the lock arm 242. Thus, for example when an external force from outside is applied on a basal end of the lock arm 242, then the lock arm 242 deforms downward, possibly causing the disengagement of the lever claw portion 236 from the lock portion 245.

In view of the above-described problem, an object of the present invention is to provide a lever type connector which can prevent the disengagement of a lever from a connector housing due to application of an external force on the connector housing, and which can ensure the rigidity to withstand the rotational operation of the lever without an increase in size.

Solution to Problem

The present invention provides, in a first aspect, a lever type connector including a connector housing arranged to receive a terminal and arranged to mate with a mating connector which is fitted from front, a lever having a pair of side plate portions and an operation portion connecting the pair of side plate portions, the side plate portions being rotatably supported on walls on both sides of the connector housing, a latch portion provided to the operation portion, a flexible arm portion extending upward from a rear end side in a connector fitting direction of an upper wall of the connector housing and having a free end extending rearward, and a latch receiving portion provided on the free end of the arm portion and arranged to latch onto the latch portion, wherein the operation portion includes an extended plate portion arranged to face the rear end side of the upper wall when the lever is rotated rearward from a standing state and the latch portion is latched onto the latch receiving portion, and wherein the extended plate portion is arranged to cover an upper surface of the arm portion.

According to the above-described structure, the lever is rotatably arranged on the connector housing, and by moving the mating terminal toward the connector housing from the front and by rotating the lever rearward, both of the connectors are completely fitted together and at the same time the latch portion is latched onto the latch receiving portion by the rotation of the lever, thereby fixing the lever to the connector housing. Thus, the rotational operation of the lever alone can completely fit the both connectors together and can fix the lever to the connector housing.

The present invention provides, in a second aspect, the lever type connector according to the first aspect wherein the arm portion is provided in a pair so that the arm portions in the pair are parallelly arranged along a left-right direction with an interval at the rear end side of the upper wall.

According to the above-described structure, since there is provided the pair of arm portions, the force applied on one arm portion can be distributed and reduced.

The present invention provides, in a third aspect, the lever type connector according to the first or the second aspect wherein the extended plate portion and the operation portion are arranged to cover from a basal portion of the arm portion to the latch receiving portion.

According to the above-described structure, since the arm portion is entirely covered by the extended plate portion and the operation portion, the arm portion can be protected from outside interference.

Advantageous Effects of Invention

According to the first aspect of the present invention, there is provided a lever type connector including a connector housing arranged to receive a terminal and arranged to mate with a mating connector which is fitted from front, a lever having a pair of side plate portions and an operation portion connecting the pair of side plate portions, the side plate portions being rotatably supported on walls on both sides of the connector housing, a latch portion provided to the operation portion, a flexible arm portion extending upward from a rear end side in a connector fitting direction of an upper wall of the connector housing and having a free end extending rearward, and a latch receiving portion provided on the free end of the arm portion and arranged to latch onto the latch portion, wherein the operation portion includes an extended plate portion arranged to face the rear end side of the upper wall when the lever is rotated rearward from a standing state and the latch portion is latched onto the latch receiving portion, and wherein the extended plate portion is arranged to cover an upper surface of the arm portion. Thus, while the connector housing is fitted to the mating connector, the disengagement of the lever from the connector housing due to the application of an external force on the connector housing can be prevented, as well as the a portion can be protected. Furthermore, since there is provided the extended plate portion, there is provided a large area to be pushed by a worker when rotatably operating the lever, thereby distributing the force applied on the area to be pushed by the worker. Thus, there is provided the lever type connector having the rigidity which can withstand the rotational operation of the lever without an increase in size.

According to the second aspect of the present invention, the arm portion is provided in a pair so that the arm portions in the pair are parallelly arranged along a left-right direction with an interval at the rear end side of the upper wall. Thus, the force applied on one of the arm portions is distributed, thereby allowing the latch claws to be latched onto the latch receiving portions in a stable manner.

According to the third aspect of the present invention, the extended plate portion and the operation portion are arranged to cover from a basal portion of the arm portion to the latch receiving portion. Thus, the disengagement of the lever from the connector housing due to the application of an external force on the connector housing can be prevented in a reliable manner, and thus the entire arm portion can be protected.

DESCRIPTION OF EMBODIMENTS

In the following, a lever type connector according to one embodiment of the present invention is explained with reference to FIGS. 1 through 16.

Figure 1:
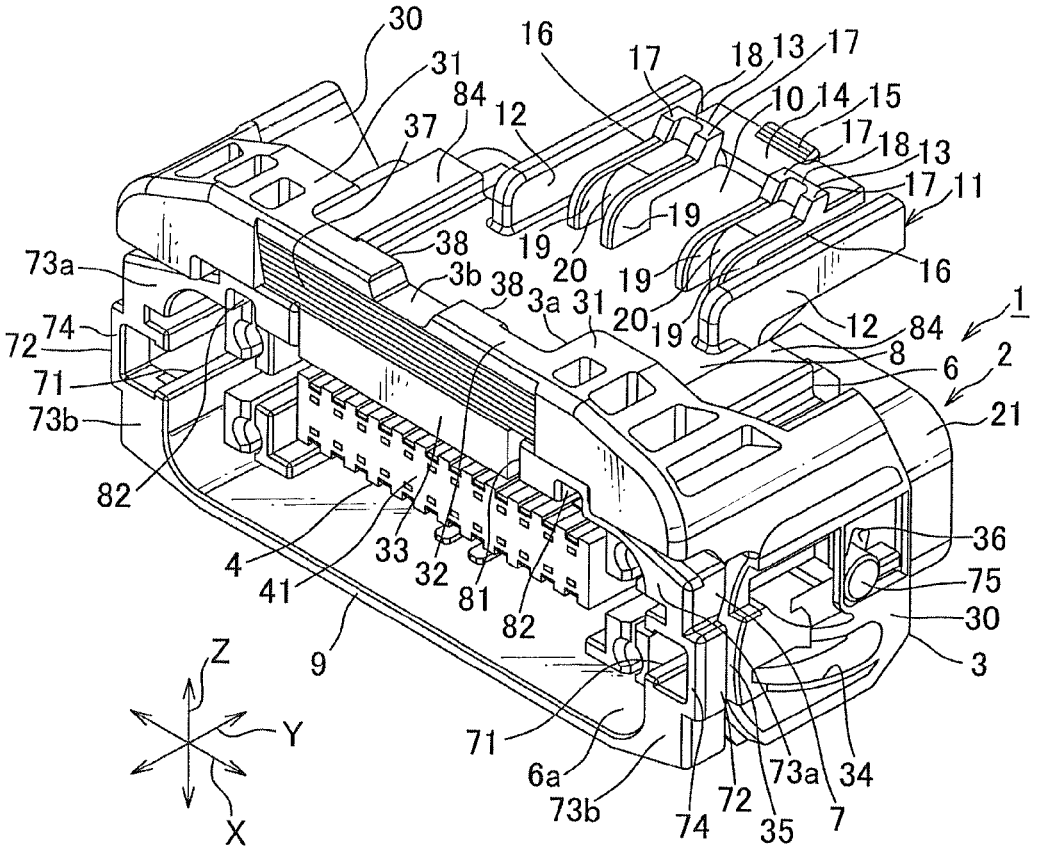
FIG. 1 is a perspective view showing one embodiment of a lever type connector according to the present invention.

As shown in FIG. 1, a lever type connector includes a terminal (not shown), a connector housing 2 made of insulating resin and receiving the terminal, and a lever 3 rotatably provided to the connector housing 2.

Figure 2:
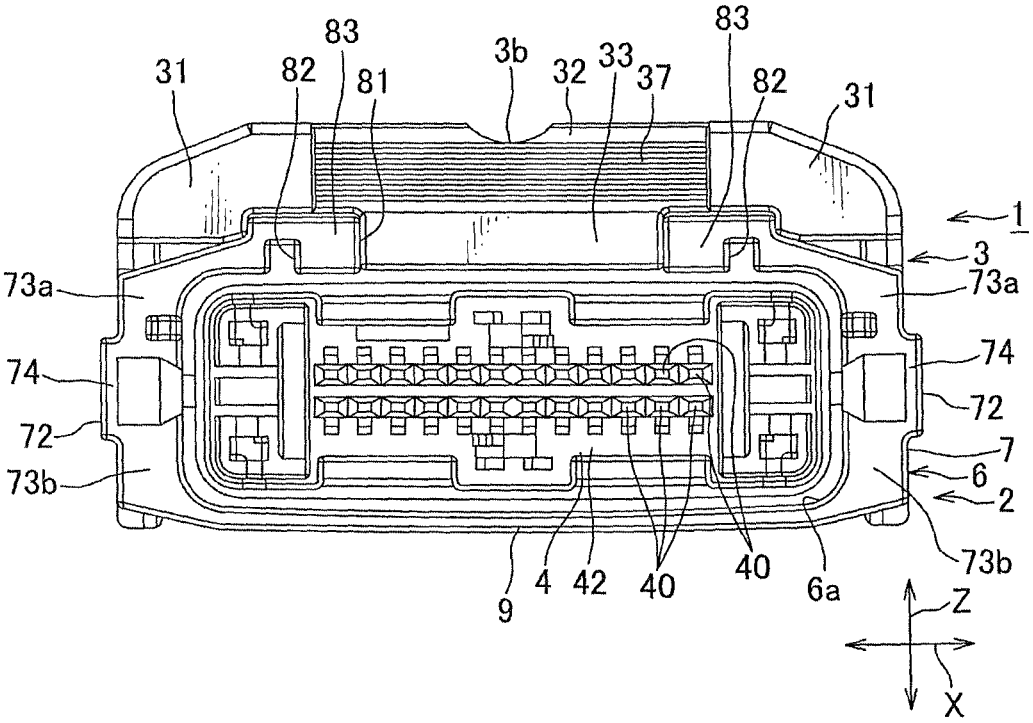
FIG. 2 is a front view of the lever type connector shown in FIG. 1.
Figure 3:
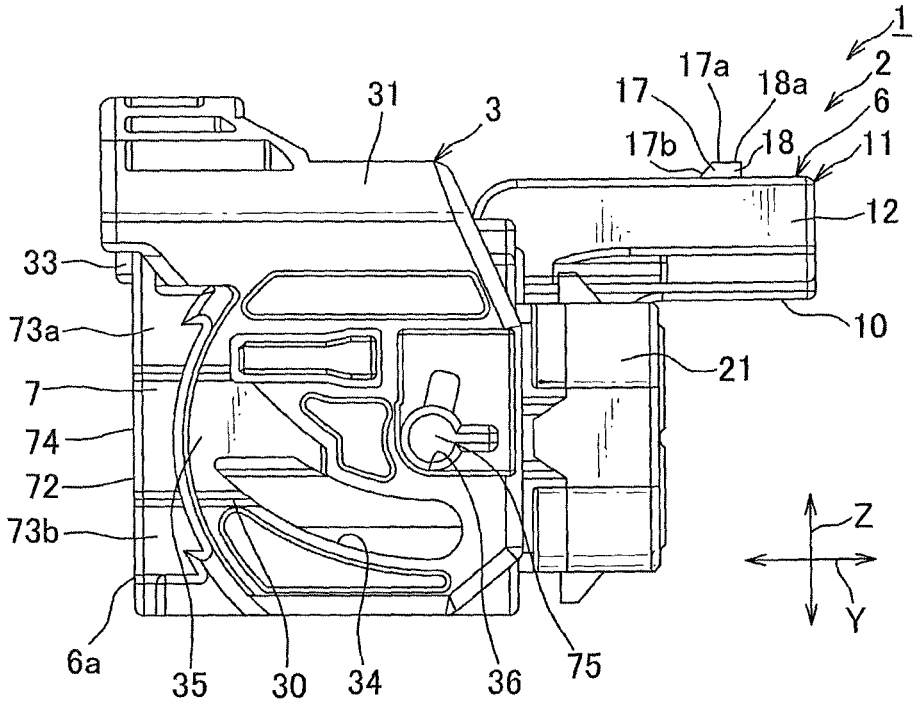
FIG. 3 is a side view of the lever type connector shown in FIG. 1.
Figure 4:
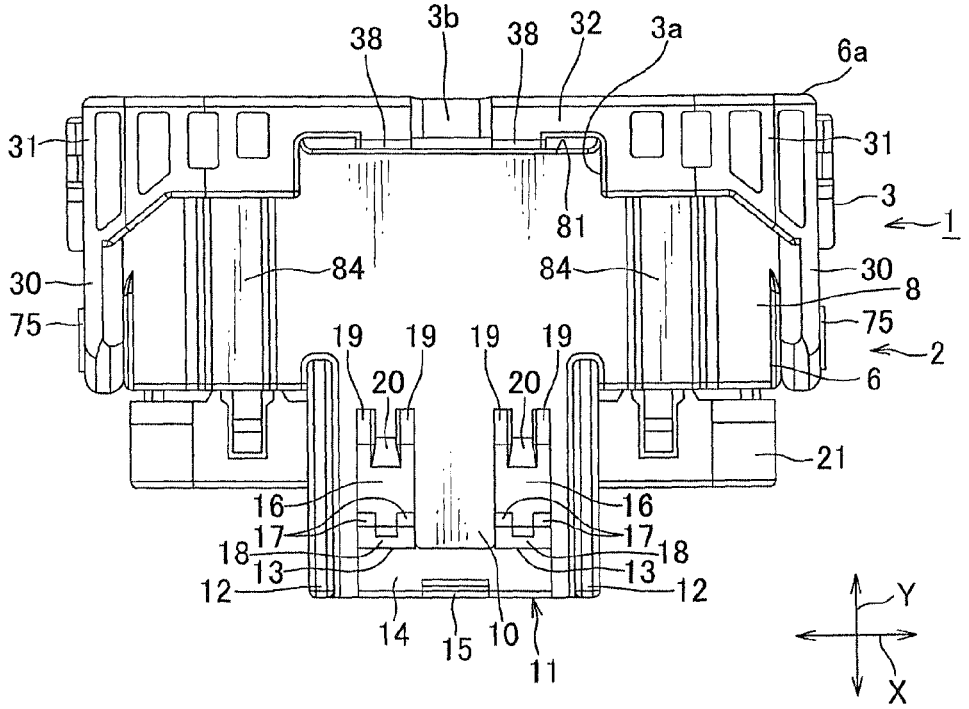
FIG. 4 is a top view of the lever type connector shown in FIG. 1.

As shown in FIGS. 1-3, the connector housing 2 includes a housing main portion 4 having a plurality of terminal receiving portions 40 (shown in FIG. 2), a hood portion 6 provided outside of the housing main portion 4 and arranged to engage with a mating terminal 5 which is engaged from the front, and a rear holder 21 mounted from the back of the hood portion 6.

As shown in FIGS. 1 and 2, the housing main portion 4 includes an inner housing 41 formed integrally with the hood portion 6 and a front holder 42 (shown in FIG. 2). In FIG. 1, the front holder 42 is omitted.

Figure 5:
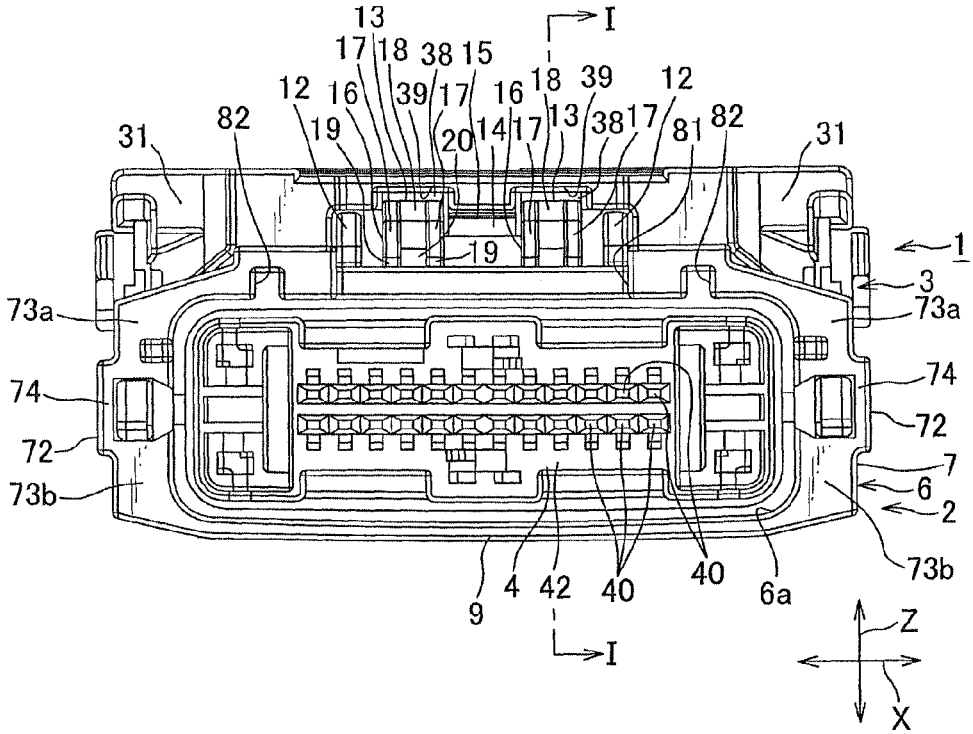
FIG. 5 is a front view of the lever type connector of FIG. 1 latched onto a connector lock portion.
Figure 6:
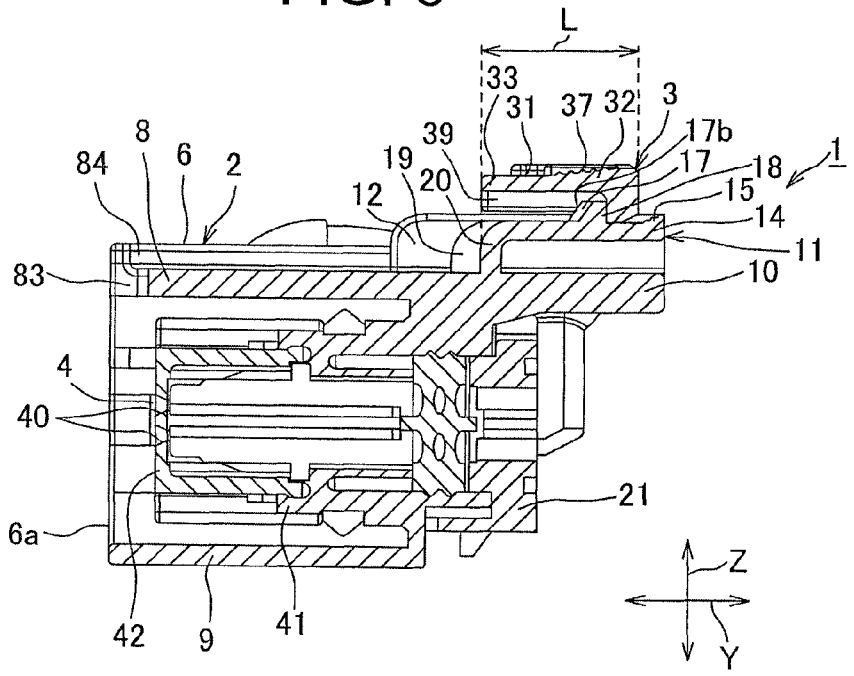
FIG. 6 is a cross-sectional view taken along the line I-I in FIG. 5.

As shown in FIGS. 2, 5 and 6, the front holder 42 is mounted to the inner housing from the front, and the plurality of terminal receiving portions 40 are formed by mounting the front holder 42 to the inner housing 41. The plurality of terminal receiving portions 40 is arranged in two rows along an up-down direction Z and parallelly aligned along a left-right direction X at an interval with respect to each other.

Herein, a front-rear direction Y indicates a connector fitting direction as well as a longitudinal direction of each terminal receiving portion 40, as shown in FIG. 6. The term "front" is indicative of side of a later-described opening portion 6*a* of the hood portion 6 in the front-rear direction Y, and the term "rear" is indicative of the opposite side of the opening portion 6*a* with respect to the "front".

Figure 7:
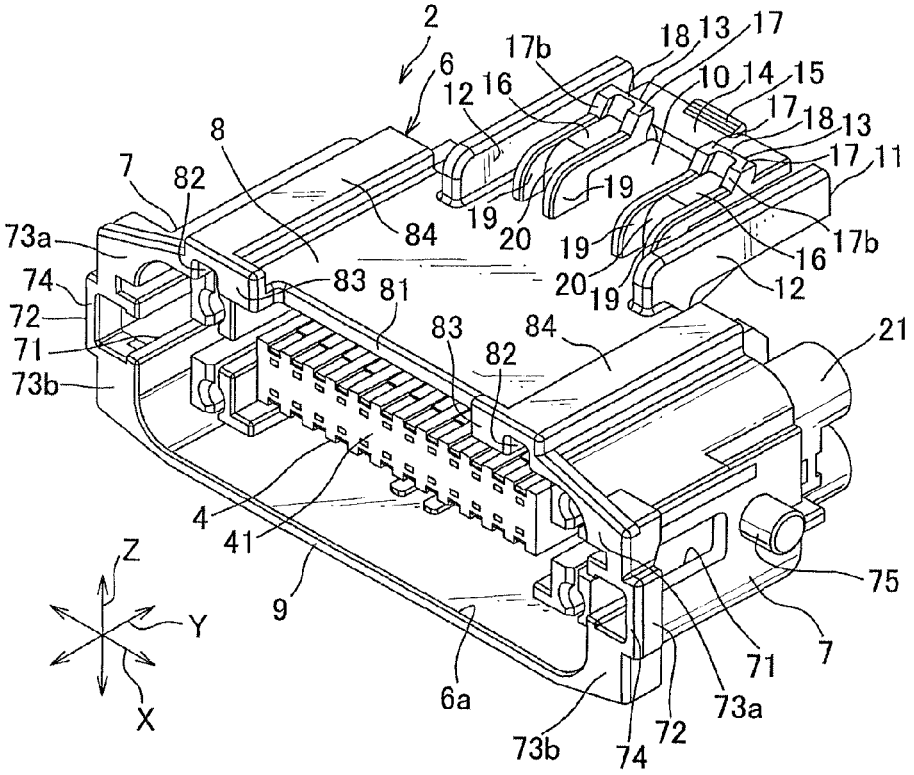
FIG. 7 is a perspective view of a connector housing of the lever type connector shown in FIG. 1.

As shown in FIG. 6, each of the above-described terminal receiving portions 40 is formed into a rectangular tube-like shape having an opening provided on the front and rear sides. A terminal connected to an electric wire (not shown) is inserted into each terminal receiving portion 40 from the opening on the rear side. In addition, a lance (not shown) is provided at an inner side of each terminal receiving portion 40 for stopping the terminal connected to the electric wire in an engaged fashion As shown in FIG. 7, the hood portion 6 includes a pair of side wall portions 7 opposed in the left-right direction X, an upper wall 8 and a lower wall 9 connecting the pair of side wall portions 7, a rearward extended wall 10 extending to the rear side of the upper wall 8, and a connector lock portion 11. The hood portion 6 includes the opening portion 6*a* into which the mating connector 5 is fitted, the opening portion 6*a* being formed on the front side of the hood portion 6. In FIG. 7, the front holder 42 is omitted.

The pair of side wall portions 7 includes a pair of slit portions 71, a pair of opening-prevention portions 72 which reinforces the pair of slit portions 71, and a pair of shaft portions 75 provided to support the lever. The pair of side wall portions 7 corresponds to "walls on both sides" described in claims.

The above-described pair of slit portions 71 is provided for guiding a later-described driven pin 55 of the mating connector 5. The pair of slit portions 71 is arranged in communication with a later-described cam hole 34 of the lever 3 and is arranged so as to allow the driven pin 55 of the mating connector 5 enter into the pair of slit portions 71. Each slit portion 71 is formed by cutting out an edge of each side wall portion 7 on the front side (i.e. on the side adjacent to the opening portion) and is extending linearly in the front-rear direction Y.

Each of the pair of opening-prevention portions 72 includes a pair of first flange portions 73*a*, 73*b* arranged on both sides of the respective slit portions 71, and bridge portions 74 connecting together edges of the pair of first flange portions 73*a*, 73*b* distant from the opening portion 6*a*. The pair of first flange portions 73*a*, 73*b* extends outward from the edges of the pair of side wall portions 7 adjacent to the opening portion 6*a*.

The pair of shaft portions 75 is formed into a columnar shape and is projecting horizontally from an outer surface of the respective side wall portions 7. The respective shaft portions 75 are provided on a rear end side of the respective slit portions 71.

As shown in FIG. 7, the above-described upper wall 8 includes a cut-out portion 81 for locating a later-described extended plate portion 33 of the lever 3 inside of the cut-out portion 81, a pair of second flange portions 83 provided on both sides of the cut-out portion 81, and a pair of grooves 82 for guiding the mating connector 5.

The cut-out portion 81 is provided at a central portion of the upper wall 8 and formed by cutting out an edge adjacent to the opening portion 6*a*. The dimension in the left-right direction X of the cut-out portion 81 is thrilled into the same dimension as the later-described extended plate portion 33 of the lever 3.

Each of the pair of second flange portions 83 is formed continuous with the respective first flange portions 73*a*. The pair of second flange portions 83 extends outward from the edge of the upper wall 8 adjacent to the opening portion 6*a*.

The pair of grooves 82 is arranged such that a later-described pair of ribs 58 of the mating connector 5 is inserted in the pair of grooves 82. The respective grooves 82 are provided at an under surface of the upper wall 8. The respective grooves 82 are formed by cutting out an edge of the second flange portions 83 adjacent to the opening portion 6*a* and are extending across an entire length of the upper wall 8 in the front-rear direction Y. The dimension in the up-down direction Z of each groove 82 is formed larger than the thickness of the upper wall 8, thus a protrusion 84 is formed on an upper surface of a portion with each groove 82. The protrusion 84 is continuous with the second flange portion 83.

The above-described rearward extended wall 10 has the dimension in the left-right direction X that is smaller than the dimension of the upper wall 8 and is projecting rearward from the upper wall 8. This rearward extended wall 10 has a flat outer surface lying on the same plane as the upper wall 8. The rearward extended wall 10 corresponds to "a rear end side of an upper wall" described in claims.

Figure 8:
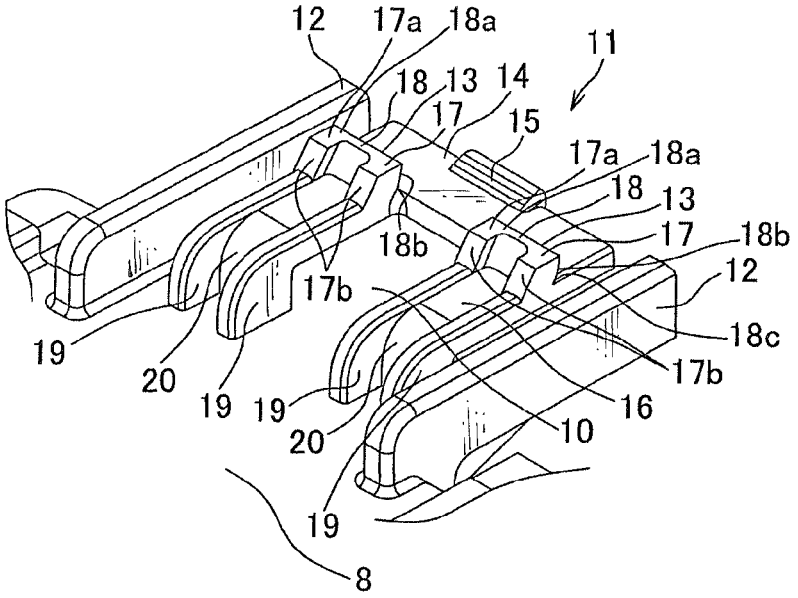
FIG. 8 is an enlarged view of the connector lock portion of the connector housing shown in FIG. 7.

As shown in FIG. 8, the above-described connector lock portion 11 includes a pair of protection walls 12, a pair of arm portions 13 provided between the pair of protection walls 12, a connection portion 14 connecting free ends of the pair of arm portions 13, and a disengagement portion 15 provided at a rear end of the connection portion 14. The connection portion 14 and basal portions of the pair of arm portions 13 adjacent the free end are arranged to face the rearward extended wall 10 with a constant space from the rearward extended wall 10.

The above-described pair of protection walls 12 is extending perpendicularly from both edges in the left-right direction X of the rearward extended wall 10. The respective protection walls 12 are extending from a rear end of the rearward wall 10 to the rear end of the upper wall 8.

The above-described pair of arm portions 13 is provided at the rearward extended wall 10. The pair of arm portions 13 is parallelly aligned in the left-right direction X with an interval between each other. A basal portion of each of the arm portions 13 includes three legs including a pair of thick leg portions 19 and a thin leg portion 20 arranged between the pair of thick leg portions 19. The pair of thick leg portions 19 and the thin leg portion 20 are aligned in the left-right direction X. Each of the arm portions 13 further includes an am main body 16 extending upward from the rearward extended wall 10 and having a free end extending toward the rear side, upwardly extending projections 17 provided on the free end of the arm main body 16, and a latch receiving portion 18 provided on a rear side of the projections 17.

Each of the pair of thick leg portions 19 has the dimension in the up-down direction Z that increases towards the rear side. The thick leg portion 19 has the dimension in the front-rear direction Y that is larger than the dimension in the front-rear direction Y of the thin lea portion 20. Also, the thick leg portion 19 has the dimension in the left-right direction X that is smaller than the dimension in the left-right direction X of the thin leg portion 20.

The above-described projections 17 are provided in a pair on both ends in the left-right direction X of the arm main body 16. Each of the projections 17 includes a slanted surface 17*b* slanted upward towards the rear side.

As shown in FIG. 3, an upper surface 17*a* of the respective projections 17 and an upper surface 18*a* of the latch receiving portion 18 which is continuous with the upper surface 17*a* are formed flat. These upper surfaces 17*a*, 18*a* are located at the upper most position in the arm portion 13. Also, these upper surfaces 17*a*, 18*a* are located higher than the respective protection walls 12.

Figure 15:
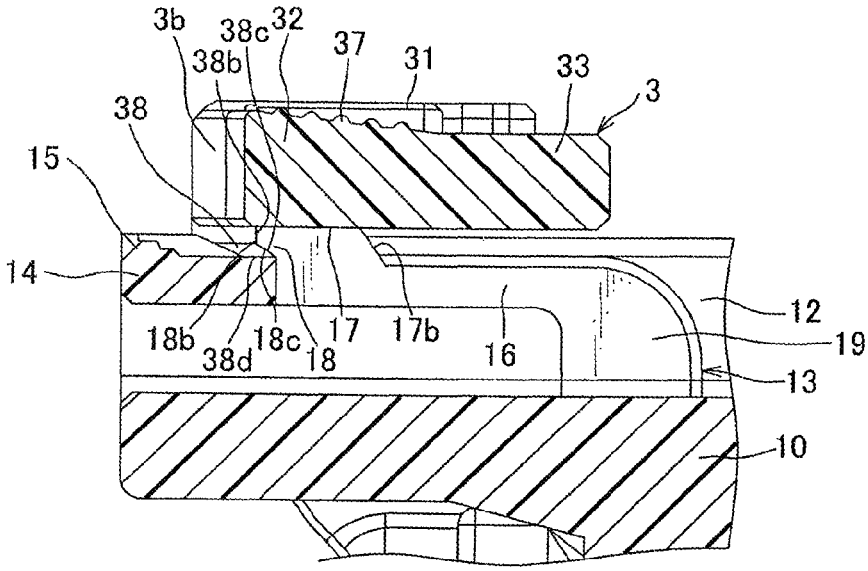
FIG. 15 is an enlarged view showing a portion shown in FIG. 14.
Figure 16:
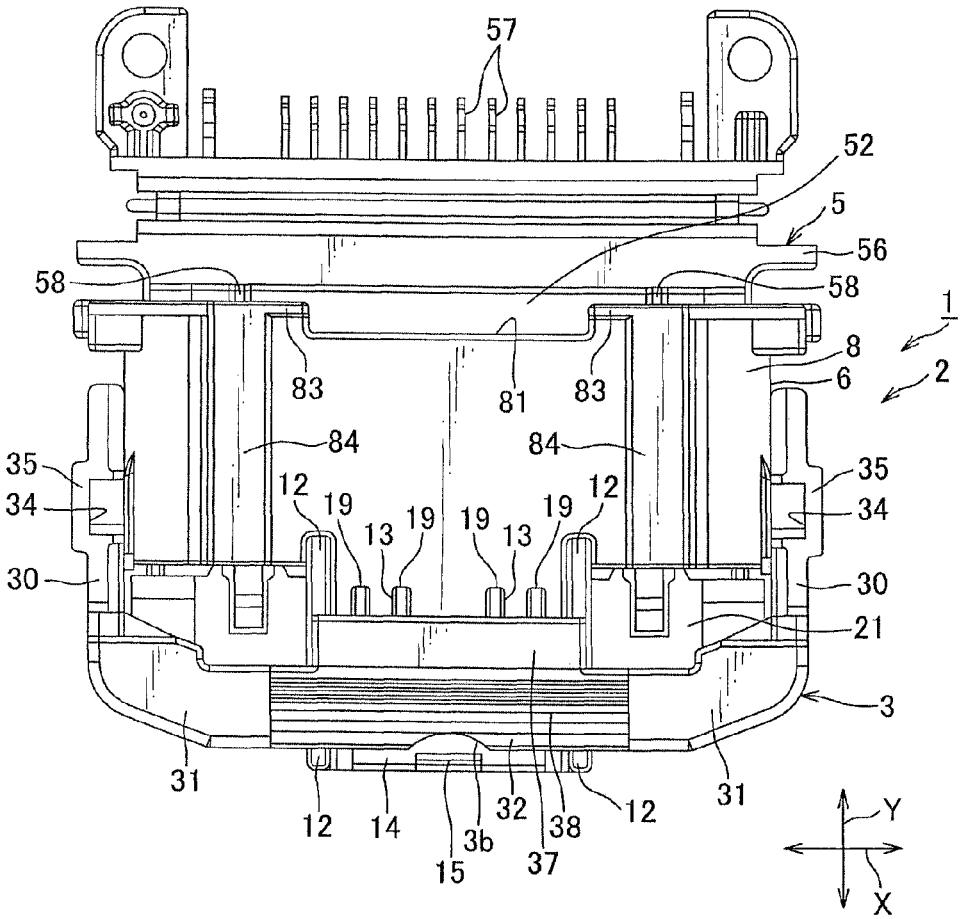
FIG. 16 is a top view of the lever type connector and the mating connector shown in FIG. 13.

As shown in FIG. 8, the latch receiving portions 18 are formed continuous with rear ends of the pair of projections 17. The latch receiving portion 18 is formed across an entire length in the left-right direction X of the arm main body 16. As shown in FIG. 15, the latch receiving portion 18 includes a vertical surface 18*b* which is perpendicular with respect to the upper surface 18*a* and a slanted surface 18*c* formed continuous with the vertical surface 18*b*. The slanted surface 18*c* is slanted upward towards the rear side. When a latch claw 38 of the lever enters between the slanted surface 18*c* and the connection portion 14, the latch claw 38 of the lever 3 is caught on the latch receiving portion 18, thereby allowing the latch claw 38 to be latched onto the latch receiving portion 18.

As shown in FIG. 8, the disengagement portion 15 is provided at a central portion in the left-right direction X of a rear end side of the connection portion 14. The disengagement portion 15 is slanted upward towards the rear side. The disengagement portion 15 includes an antislip portion formed on a surface of the disengagement portion 15.

Figure 9:
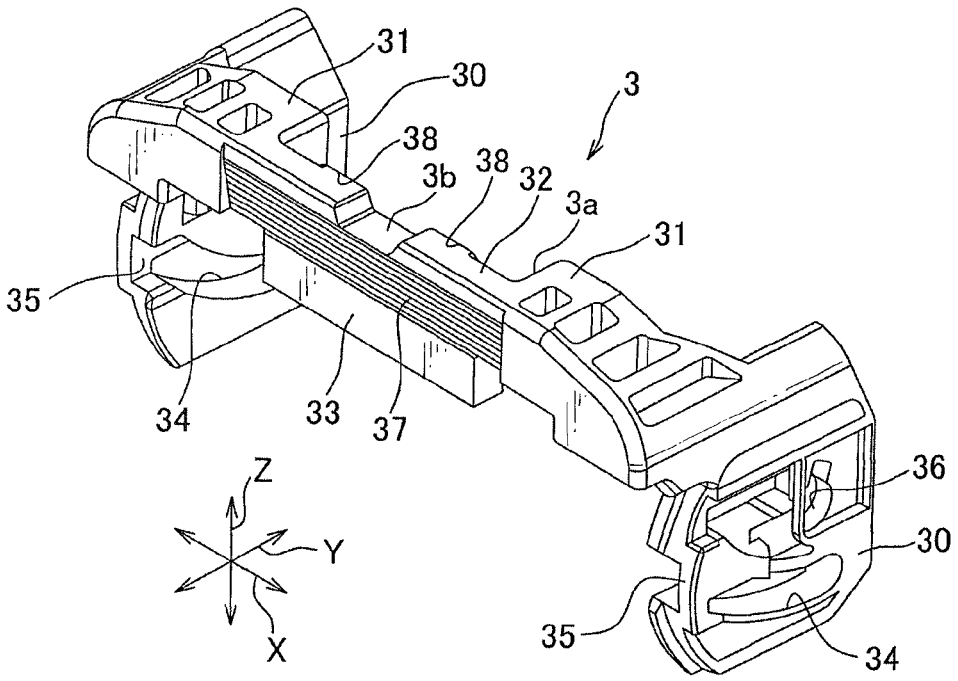
FIG. 9 is a perspective view of a lever of the lever type connector shown in FIG. 1.
Figure 10:
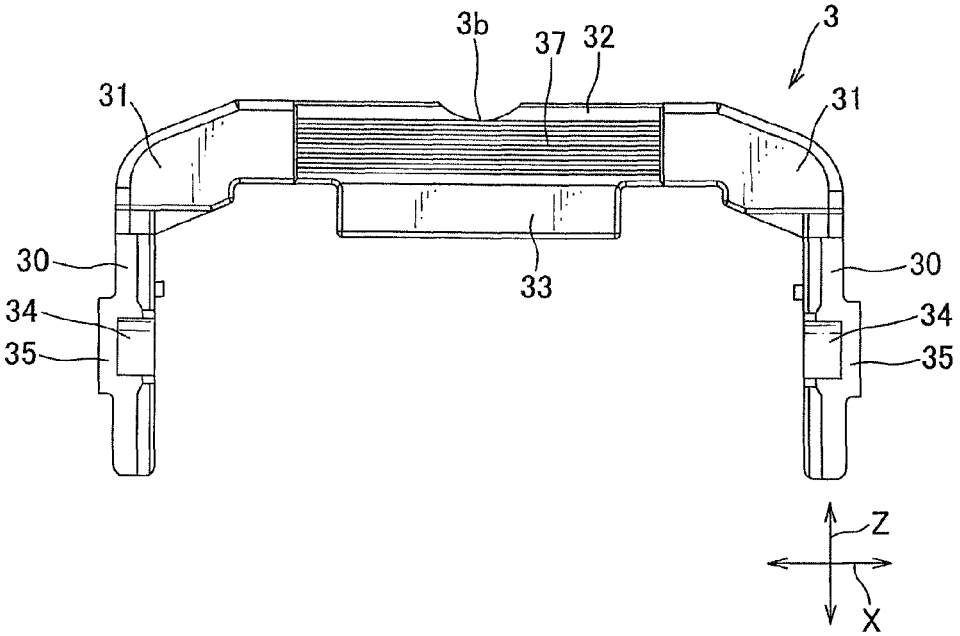
FIG. 10 is a front view of the lever shown in FIG. 9.

As shown in FIGS. 9 and 10, the lever 3 is formed into a U-shape with a pair of side plate portions 30 arranged with an interval between each other, a pair of middle portions 31 formed continuous with inner sides of the pair of side plate portions 30, an operation portion 32 formed continuously between the pair of middle portions 31, and the extended plate portion 33 formed continuously below the operation portion 32. In a lever standing state, the operation portion 32 and the extended plate portion 33 are continuous in a direction perpendicular to the upper surface of the upper wall 8. In other words, when used herein the term "lever standing state" means that the direction along which the operation portion 32 and the extended plate portion 33 are formed continuous is parallel to the direction Z which is perpendicular to the upper surface of the upper wall 8. Furthermore, a groove 3*a* is provided on the rear side of the operation portion 32 and the extended plate portion 33 in the lever standing state, the groove 3*a* being arranged such that the connector lock portion 11 is received inside of the groove 3*a* when the lever 3 is rotated rearward from the standing state. The groove 3*a* is extending in the up-down direction Z.

Referring to FIG. 6, a dimension L of the operation portion 32 and the extended plate portion 33 in the direction along which the operation portion 32 and the extended plate portion 33 are formed continuous is the same as the length from the latch receiving portion 18 of the arm portion 13 to the thin leg portion 20 which is the basal portion of the arm portion 13. That is, when the latch claw 38 of the lever 3 is latched onto the latch receiving portion 18 of the connector lock portion 11, the extended plate portion 33 and the operation portion 32 covers the upper surface of the arm portion 13 from the basal portion to the latch receiving portion 18 of the arm portion 13.

Each of the side plate portions 30 includes the cam hole 34 into which the later-described driven pin 55 of the mating connector 5 enters, a plate-like reinforcement piece 35 which connects both ends at an entrance of the cam hole 34, and a circular hole 36 in which the above-described shaft portion 75 of the connector housing 2 is fitted. The cam hole 34 is curved at the rear side to which the lever 3 is turned down. An entrance of the cam hole 34 is provided at a tip end of the cam hole in the lever standing state so that the driven pin 55 of the mating connector 5 is inserted into the entrance. The circular hole 36 is provided near a rear end of the cam hole 34. The cam hole 34 may be a cam groove formed on an inner surface of the side plate portion 30.

Figure 12:
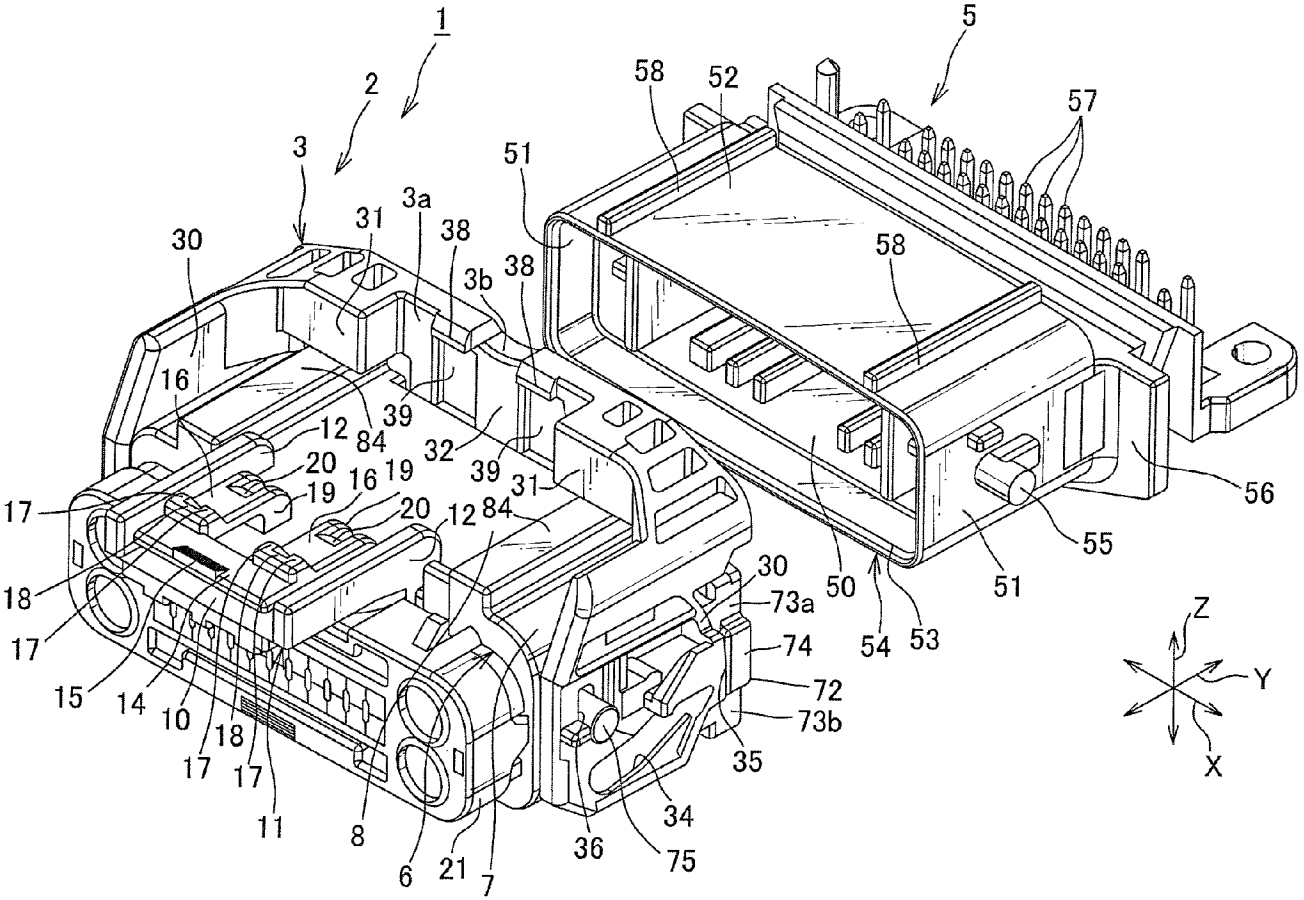
FIG. 12 is a perspective view showing the lever type connector of FIG. 1 fitted to the mating connector.
Figure 13:
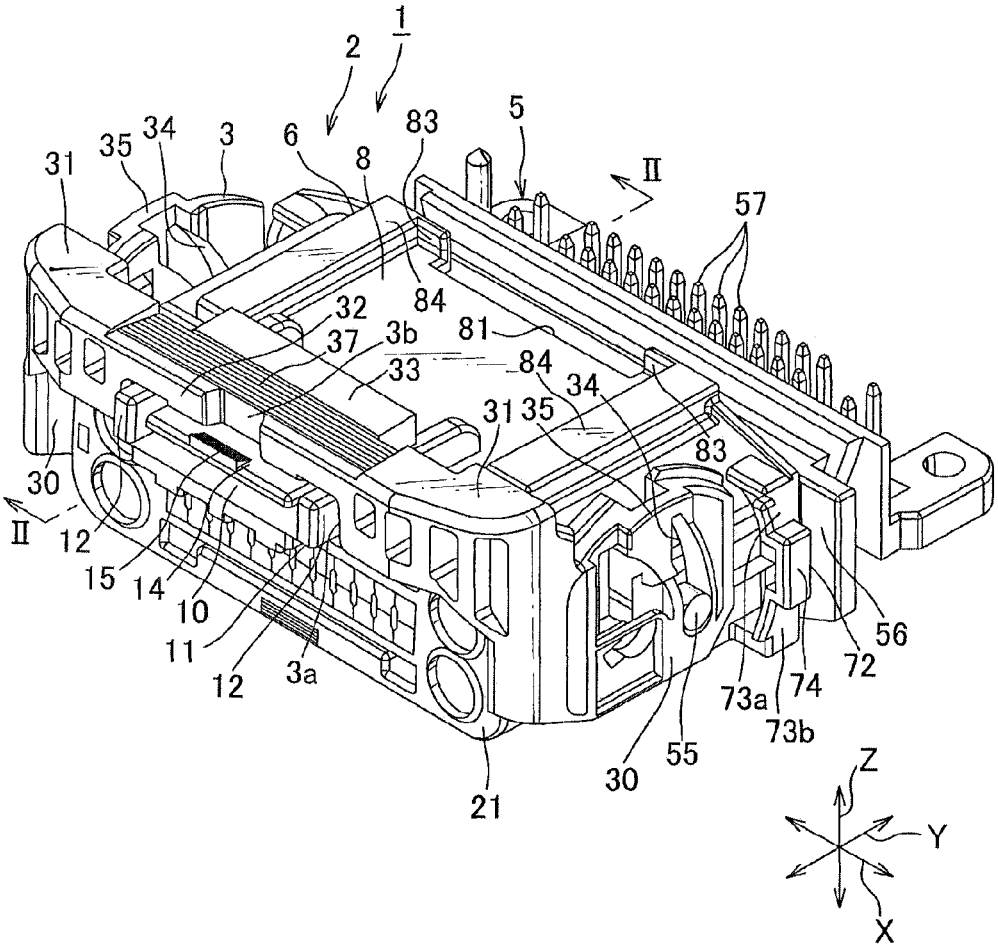
FIG. 13 is a perspective view showing a state in which the lever type connector of FIG. 1 is fitted to the mating connector.
Figure 14:
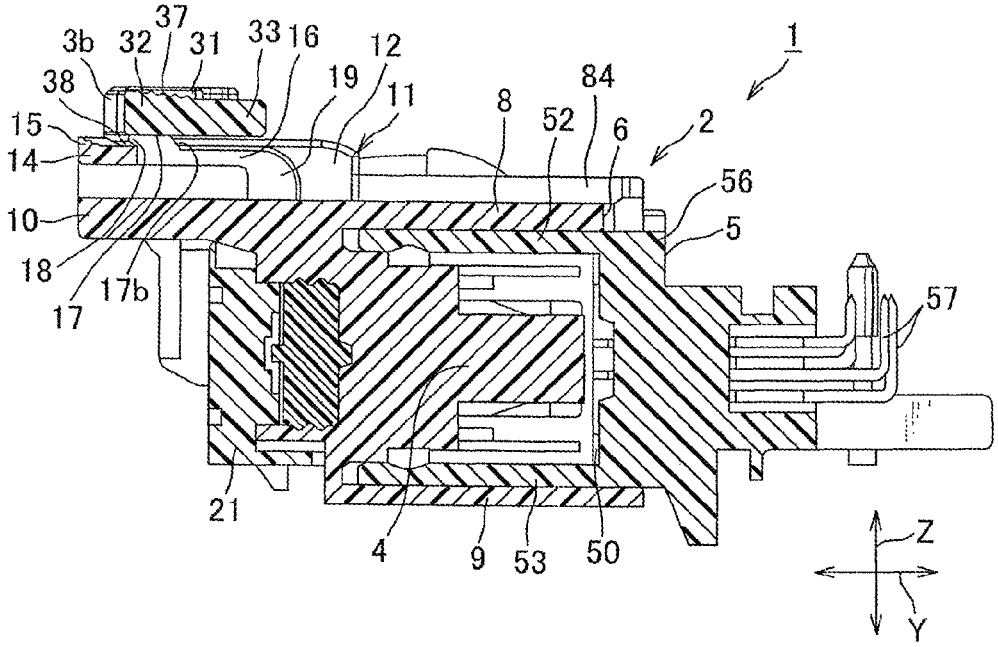
FIG. 14 is a cross-sectional view taken along the line in FIG. 13.

As shown in FIGS. 10 and 12, the operation portion 32 is provided at a central portion between the pair of side plate portions 30. The operation portion 32 includes an antislip portion 37 formed on a front surface in the lever standing state and slanted rearward towards the lower side, the pair of latch claws 38 formed on a rear surface and arranged to latch onto the pair of latch receiving portions 18 of the arm portion 13, the pair of concave portions 39 formed respectively on the lower side of the pair of latch claws 38, and a cut-out portion 3*b* provided between the pair of latch claws 38 and formed by cutting out an upper edge of the operation portion 32. The cut-out portion 3*b* allows the disengagement portion 15 of the connector lock portion 11 to be exposed to outside when the lever 3 is turned down.

As shown in FIG. 12, the pair of latch claws 38 is arranged along the left-right direction X at an interval. The respective latch claws 38 are arranged on an upper end of the operation portion 32 in the lever standing state and are projecting from the rear surface of the operation portion 32. Also, the tip ends of the respective latch claws 38 are extending downward. As shown in FIG. 15, the latch claw 38 includes a second vertical surface 38*b* which abuts on the vertical surface 18*b* of the latch receiving portion 18 when the lever 3 is turned down, a second slanted surface 38*c* formed continuous with the second vertical surface 38*b* and arranged to abut on the slanted surface 18*c*, and a horizontal surface 38*d* formed continuous with the second slanted surface 38*c* and arranged to be placed on the upper surface of the connection portion 14. The pair of latch claws 38 corresponds to "pair of latch portions" described in claims.

The above-described pair of concave portions 39 is extending all the way to the extended plate portion 33.

Referring to FIG. 10, the extended plate portion 33 is arranged at a central portion of the operation portion 32. The extended plate portion 33 has the dimension in the left-right direction X that is shorter than the dimension in the left-right direction X of the operation portion 32. The dimension in the up-down direction Z of the extended plate portion 33 in the lever standing state is the same as the second flange portion 83 of the upper wall 8.

When latching the latch claws 38 of the lever 3 onto the latch receiving portions 18 of the connector housing 2, as shown in FIG. 15, firstly the lever 3 is rotated rearward from the standing state so that the tip ends of the latch claws 38 abut on the upper surfaces 18*a* of the latch receiving portions 18 and push the projections 17 and the latch receiving portions 18 downward so that the arm main body 16 is deformed downward, and subsequently, the latch claws 38 move on and over the latch receiving portions 18, and the tip ends of the latch claws 38 enter between the latch receiving portions 18 and the connection portion 14. Thus, the second vertical surfaces 38*b* of the latch claws 38 abut on the vertical surfaces 18*b* of the latch receiving portions 18 and the second slanted surfaces 38*c* abut on the slanted surfaces 18*c*, and at the same time, the arm main bodies 16 are restored to an original state before being deformed, thereby latching the latch claws 38 onto the latch receiving portions 18.

Furthermore, when disengaging the latch claws 38 of the lever 3 from the latch receiving portions 18 of the connector housing 2, firstly, while the latch claws 38 are latched onto the latch receiving portions 18, the disengagement portion 15 is pushed downward and the connection portion 14 is pushed downward, by which the arm main body 16 is deformed downward and the latch receiving portions 18 are pushed downward, so that the latch claws 38 are removed from between the latch receiving portions 18 and the connection portion 14, thereby allowing the latch claws 38 to be disengaged from the latch receiving portions 18.

In the lever type connector 1 having the above-described structure, the pair of side plate portions 30 of the lever 3 is deformed in the outward direction so that the pair of shaft portions 75 of the connector housing 2 is fitted in the circular hole 36 of the lever 3, thereby rotatably supporting the lever 3 at the connector housing 2 to assemble. At this time, the lever type connector 1 is in the lever standing state.

Figure 11:
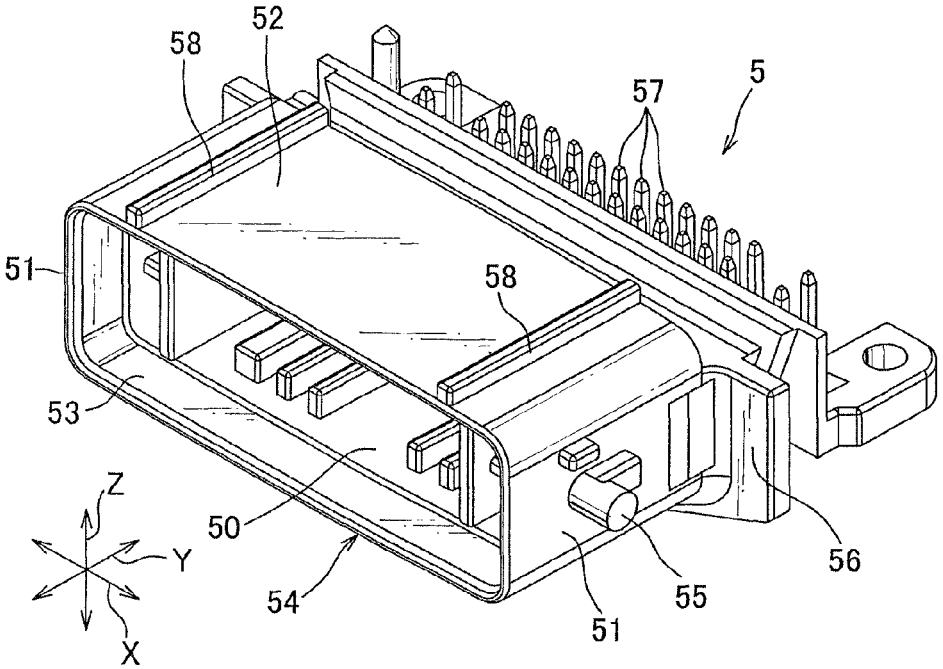
FIG. 11 is a perspective view of a mating connector arranged to be fitted to the lever type connector shown in FIG. 1.

Referring to FIG. 11, the above-described mating connector 5 includes a pair of side wall portions 51 opposed along the left-right direction X, an upper wall portion 52 and a lower portion 53 connecting the pair of side wall portions 51, a connector housing 54 having a connector fit chamber 50 surrounded by the wall portions 51, 52, 53 located in the up-down and left-right sides, the pair of driven pins 55 projecting horizontally from an outer surface of the connector housing 54, a vertical base wall 56 located in the front, a male-type pin-shaped terminal 57 (hereinafter called the male terminal 57) penetrating through the base wall 56 and projecting into the connector fit chamber 50, and a pair of ribs 58 arranged to be inserted into the pair of grooves 82 described above.

Next, the following will explain the procedure for fitting the lever type connector 1 having the above-described structure to the mating connector 5. Firstly, the mating connector 5 is moved closer to the lever type connector 1 which is in the lever standing state from the front so that the driven pins 55 enter in the slit portions 71 and the cam holes 34 which are in communication with respect to each other. Then the lever 3 is rotated rearward to move the driven pins 55 in the slit portions 71 and the cam holes 34 to pull the connector housing 54 of the mating connector 5 into the connector housing 2. Then, the latch claws 38 are latched onto the latch receiving portions 18, and the male terminals 57 of the mating terminal 5 are fitted to the terminals received in the connector housing 2 (which are female type), thereby fitting the mating terminal 5 to the lever type connector 1.

Figure 17:
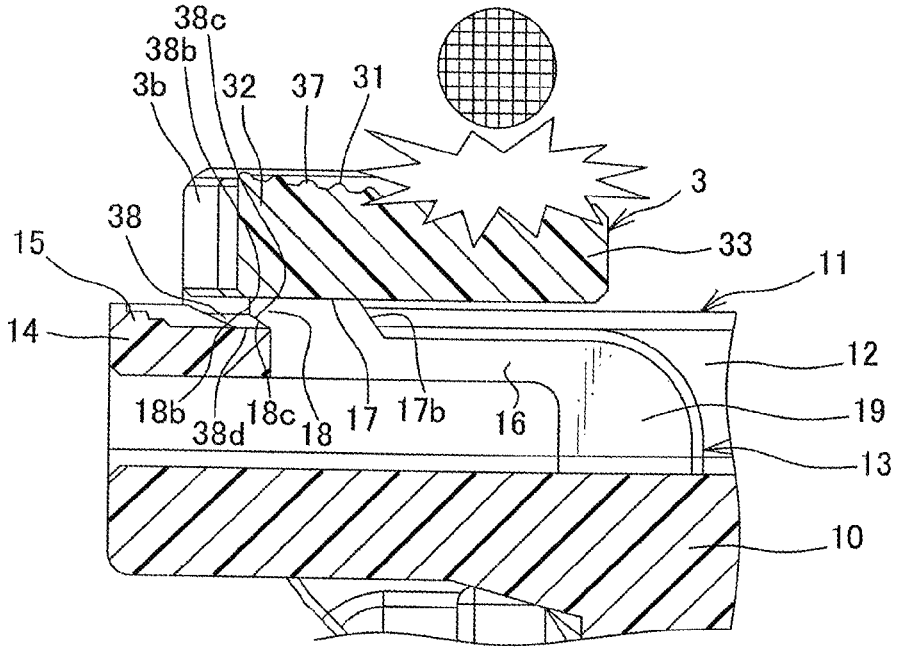
FIG. 17 is an illustrative view showing operation of the lever type connector shown in FIG. 1.
Figure 18:
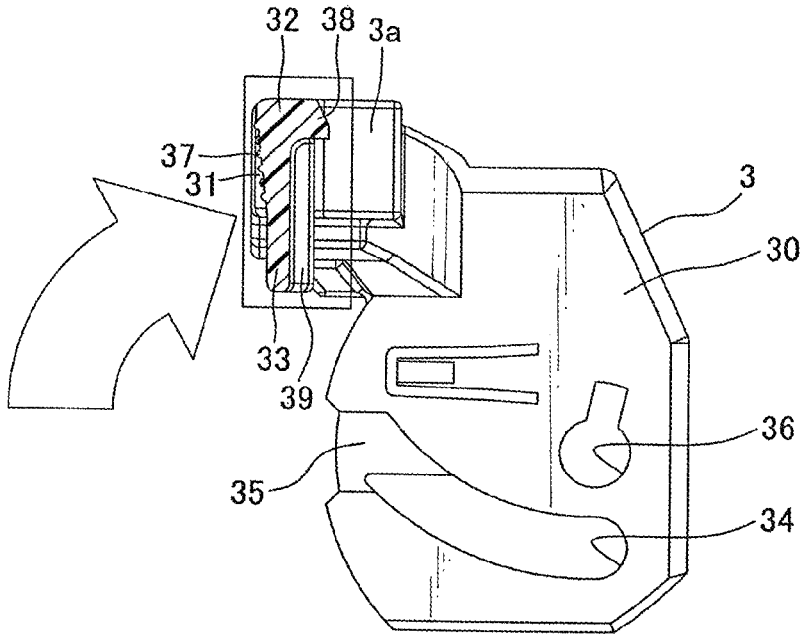
FIG. 18 is an illustrative view showing operation of the lever type connector shown in FIG. 1.

According to the above-described embodiment, when the lever 3 is rotated rearward from the standing state and the latch claws 38, which correspond to the latch portions, are latched onto the latch receiving portions 18, the extended plate portion 33 arranged at the operation portion 32 opposes to the rearward extended wall 10, which corresponds to the rear end side of the upper wall 8, such that the extended plate portion 33 covers the upper surface of the arm portion 13. Thus, the rotational operation of the lever 3 alone can completely fit the both connectors 1, 5 together and can fix the lever 3 to the connector housing 2. Also, as shown in FIG. 17, while the connector housing 2 is fitted to the mating terminal 5, the disengagement of the lever 3 from the connector housing 2 due to the application of an external force on the connector housing 2 can be prevented, thereby protecting the arm portions 13. Furthermore, as shown in FIG. 18, by providing the extended plate portion 33, there is provided large area to be pushed by a worker when rotatably operating the lever 3, thereby distributing the force applied on the area to be pushed by the worker. Consequently, there is provided the lever type connector 1 having the rigidity which can withstand the rotational operation of the lever without an increase in size.

Furthermore, the arm portions 13 are provided in a pair and are parallelly arranged on the left-right sides on the rear end side of the upper wall 8. Consequently, the force applied to one of the aim portions 13 is distributed, thereby allowing the latch claws 38 to be latched onto the latch receiving portions in a stable manner.

Moreover, since the extended plate portion 33 and the operation portion 32 cover from the basal portions of the arm portions 13 to the latch receiving portions 18, the disengagement of the lever 3 from the connector housing 2 due to the application of an external force on the connector housing 2 can be prevented in a reliable manner, thereby protecting the entire arm portions 13.

Figure 19A:
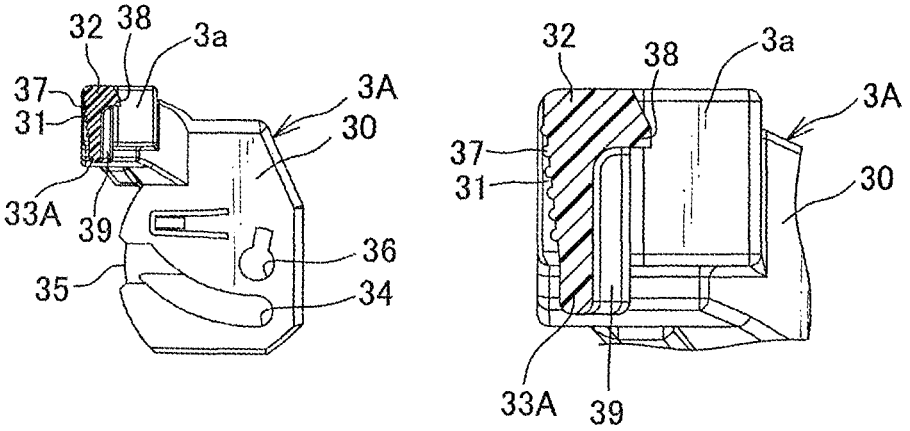
FIG. 19A is a side view showing a modified embodiment of the lever shown in FIG. 9.
Figure 19B:
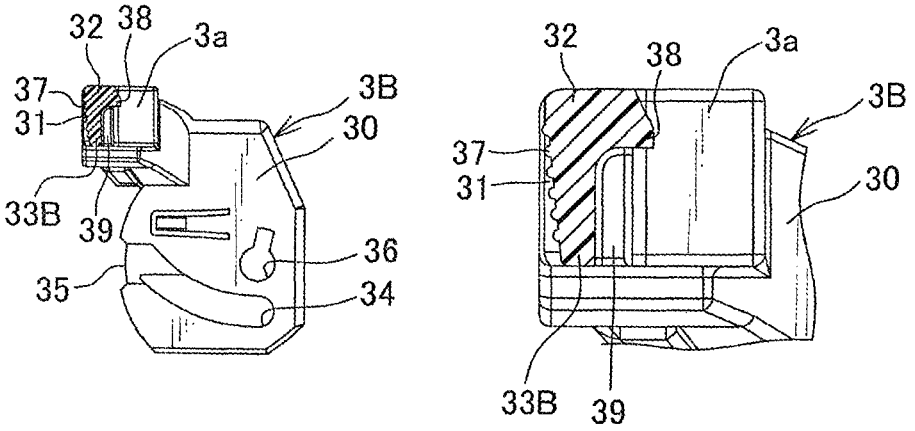
FIG. 19B is a side view showing a modified embodiment of the lever shown in FIG. 9.
Figure 20:
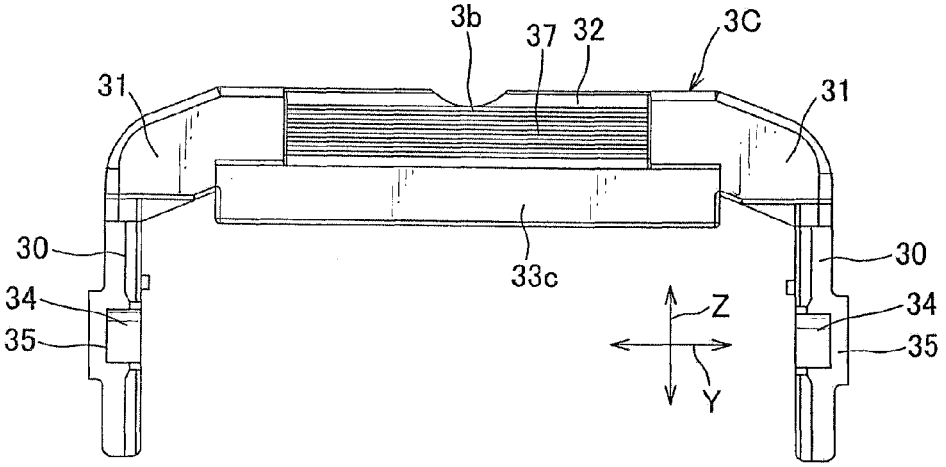
FIG. 20 is a side view showing another modified embodiment of the lever shown in FIG. 9.
Figure 21:
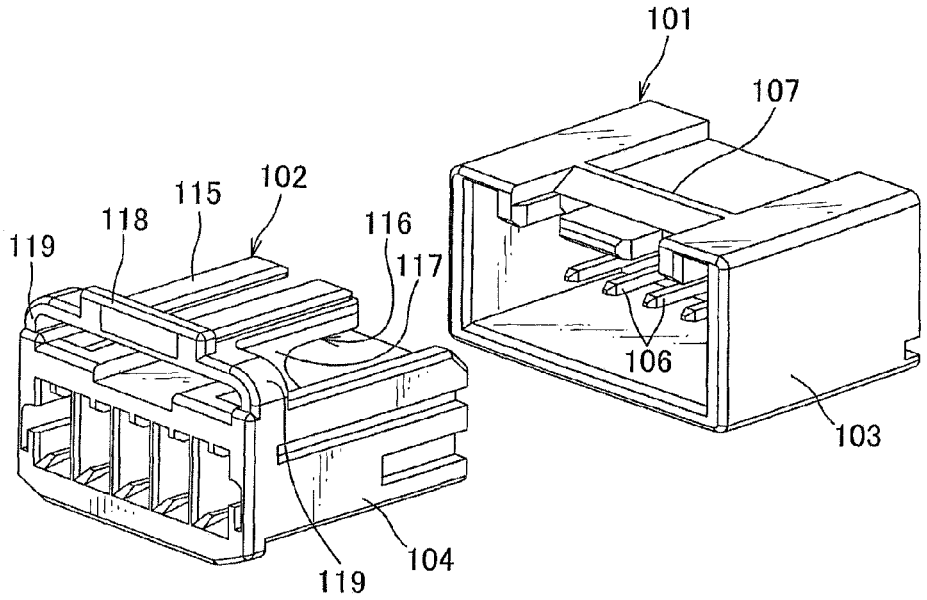
FIG. 21 PRIOR ART
FIG. 21 is an exploded perspective view showing a connector including a conventional lock structure.
Figures 22A, 22B:
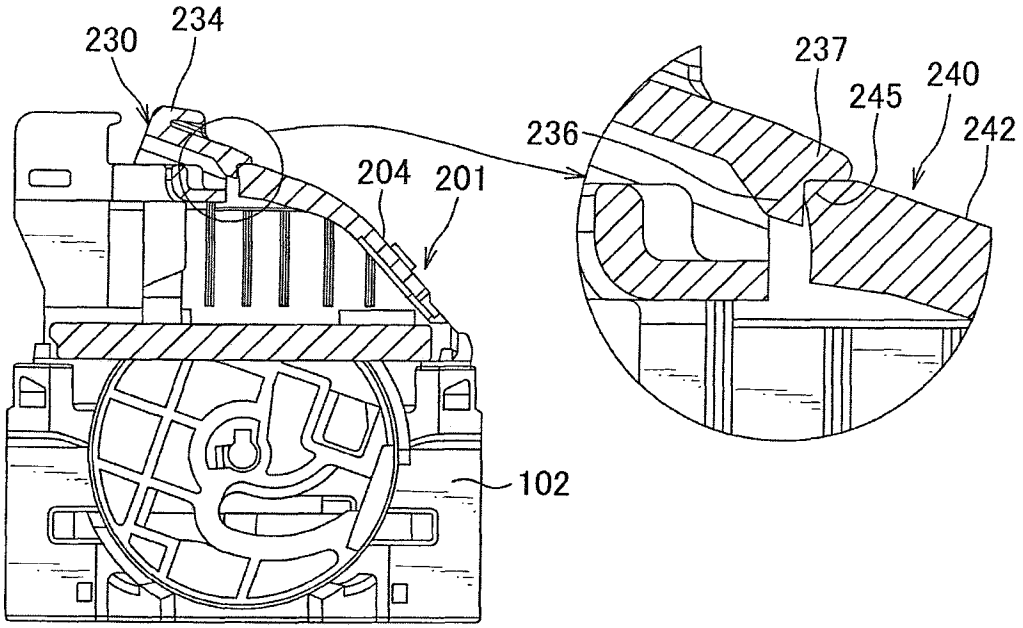
FIG. 22A PRIOR ART
FIG. 22B PRIOR ART
FIG. 22A is a partial cross-sectional view of a conventional lever type connector.
FIG. 22B is an enlarged view of a portion shown in FIG. 22A.

Moreover, as shown in FIGS. 19A and 19B, the dimension in the up-down direction Z, the dimension in the left-right direction X or the dimension in the front-rear direction Y of the above-described extended plate portion 33 in the lever standing state may be changed in accordance with allowed space provided. That is, as shown in FIG. 19A, in the lever standing state, the dimension in the up-down direction Z of an extended plate portion 33A of a lever 3A may be formed smaller than the dimension in the up-down direction Z of the extended plate portion 33 of the above-described embodiment, or alternatively, as shown in FIG. 19B, in the lever standing state, the dimension in the front-rear direction Y of an extended plate portion 33B of a lever 3B may be formed larger than the dimension in the front-rear direction Y of the extended plate portions 33, 33A of the above-described embodiments. Furthermore, the extended plate portion 33 according to the above-described embodiment has the dimension in the left-right direction X that is smaller than the dimension in the left-right direction X of the operation portion 32; however, the present invention is not limited to this, and as shown in FIG. 20, the dimension in the left-right direction X of an extended plate portion 33C of a lever 3C may be formed larger than the dimension in the left-right direction X of the operation portion 32. In FIGS. 19A, 19B and 20, like reference signs are used for elements similar to the above-described embodiment to omit explanation.

Thus, by variously changing the dimension in the up-down direction Z, the dimension in the left-right direction X, or the dimension in the front-rear direction Y of the extended plate portion 33A, 33B, 33C, there can be provided the lever type connector having the rigidity which can withstand the rotational operation of the lever without an increase in size.

Moreover, the lever 3 according to the above-described embodiment is provided with the circular hole 36 to which the shaft portion 75 of the connector housing 2 is fitted; however the present invention is not limited to this, and the lever 3 may be provided with a shaft portion and the connector housing 2 may be provided with a circular hole to which the shaft portion of the lever 3 is fitted. Furthermore, the circular hole 36 may be concave with respect to the inner surface of the side plate portion 30.

The embodiments described above are only representative embodiments of the present invention, and the present invention is not limited to these embodiments. That is, the embodiments can be changed and performed in various ways without departing from the scope of the present invention.

REFERENCE SIGNS LIST

1 lever type connector
2 connector housing
3, 3A, 3B, 3C lever
5 mating terminal
7 pair of side wall portions (walls on both sides)
8 upper wall
10 rearward extended wall
11 connector lock portion
13 pair of arm portions
16 arm main body
17 projection
18 latch receiving portion
19 thick leg portion (basal portion of the arm portion)
20 thin leg portion (basal portion of the arm portion)
30 pair of side plate portions
32 operation portion
33, 33A, 33B, 33C extended plate portion
38 latch claw (latch portion)

The invention claimed is:

1. A lever type connector comprising a connector housing arranged to receive a terminal and arranged to mate with a mating connector which is fitted from front, a lever having a pair of side plate portions and an operation portion connecting the pair of side plate portions, the side plate portions being rotatably supported on walls on both sides of the connector housing, a latch portion provided to the operation portion, a flexible arm portion provided on a rear end side in a connector fitting direction of an upper wall of the connector housing, the arm portion having a leg portion extending upward from the upper wall of the connector housing, and an arm main body extending rearward in the connector fitting direction from an upper end of the leg portion and having a distal end at a rear end of the arm main body, and a latch receiving portion provided on the distal end of the flexible arm portion and arranged to latch onto the latch portion, wherein an extended plate portion having a width in a left-right direction shorter than that of the operation portion is formed in continuity with and below the operation portion in a lever standing state, wherein the extended plate portion is arranged to face the rear end side of the upper wall when the lever is rotated rearward from the lever standing state and the latch portion is latched onto the latch receiving portion, wherein the extended plate portion is arranged to cover an upper surface of the flexible arm portion, wherein the extended plate portion and the operation portion are arranged to cover the entire flexible arm portion from a basal portion of the flexible arm portion to the latch receiving portion, and wherein the latch portion is provided on an upper end of the operation portion in the lever standing state.

2. The lever type connector according to claim 1, wherein the flexible arm portion is provided in a pair so that the flexible arm portions in the pair are parallelly arranged along a left-right direction with an interval at the rear end side of the upper wall.

3. The lever type connector according to claim 2, further comprising a connection portion connecting the distal ends of the pair of arm portions, and a disengagement portion provided at the rear end of the connection portion, the disengagement portion adapted for disengagement of the latch receiving portion and the latch portion upon flexion of the disengagement portion.

4. The lever type connector according to claim 1, wherein the extended plate portion is provided at a central portion of the operation portion and extending downward from the operation portion in the lever standing state, and the extended plate portion is shorter than the operation portion in a direction parallel to the upper wall of the connector housing and perpendicular to the connector fitting direction in the lever standing state.

* * * * *